United States Patent [19]

Sella

[11] Patent Number: 4,587,153

[45] Date of Patent: May 6, 1986

[54] WOVEN TEXTILE FABRIC AND METHOD OF MAKING THE SAME

[75] Inventor: Nancy W. Sella, Mebane, N.C.

[73] Assignee: Fieldcrest Mills, Inc., Eden, N.C.

[21] Appl. No.: 559,741

[22] Filed: Dec. 9, 1983

[51] Int. Cl.[4] ..... B32B 3/00

[52] U.S. Cl. ..... 428/196; 5/500; 5/502; 8/114.5; 28/163; 427/272; 427/275; 427/288; 428/193; 428/229; 428/246; 428/152

[58] Field of Search ..... 428/194, 193, 196, 223, 428/225, 229, 246, 252, 212, 152; 427/242, 272, 275, 276, 288; 8/114.5; 5/482, 500, 502; 28/163

[56] References Cited

U.S. PATENT DOCUMENTS 3,553,066 1/1971 Cavalier et al. ..... 428/229
3,586,595 6/1971 Spillane ..... 428/229

*Primary Examiner*—James J. Bell
*Attorney, Agent, or Firm*—Bell, Seltzer, Park & Gibson

[57] ABSTRACT

A decorative matelasse woven fabric of multi-ply construction having predetermined outwardly bulging fabric pattern areas, some of which pattern areas are colored to present an ombre effect of shaded color areas of varying intensity of color, creating a custom look of hand painting, and a method for producing the same.

10 Claims, 8 Drawing Figures

WOVEN TEXTILE FABRIC AND METHOD OF MAKING THE SAME

DESCRIPTION OF THE INVENTION

The present invention relates to a decorative matelasse fabric of woven, multi-ply construction, such as is suitable for a bedspread, and a method for producing the same.

The object of this invention is to provide a manufactured woven fabric having a novel, custom, hand-painted appearance. The multi-ply construction of the fabric produces bulging fabric pattern areas, which are in turn supported by an intermediate ply of the fabric. At least some of the bulging fabric pattern areas are colored over predetermined areas so as to contrast with other colored and/or uncolored areas. Furthermore, in order to create the novel, hand-painted custom appearance, the colored areas of the invention have an ombre or shaded effect which results in varying intensities of shade within individual colors.

The present invention provides not only an ombre color effect, but additionally and more particularly, an orientation of the ombre effect to particular raised or bulging patterned areas of the fabric so that the color covers certain specific and defined raised areas of the fabric pattern. This positioning or orienting of the color to the raised pattern gives the fabric a novel, custom, individualized appearance that would ordinarily not be expected in a manufactured product. The shading or ombre effect within each color adds to this individualized appearance.

In addition to the decorated fabric itself, the present invention includes a commercial method for producing the fabric and, as will be seen, an advantage and novelty of this invention are the steps used to produce the fabric. In particular, the method anticipates the following steps.

Initially, a particular pattern of choice is woven in a multi-ply matelasse fabric, such as a triple-ply 100 percent cotton matelasse fabric. In a typical and preferred embodiment, the fabric comprises three plies or layers, interwoven together. The face ply, which will eventually receive the color, is closely woven with a particular pattern therein. The back ply, which will eventually be shrunken to produce the outwardly bulging pattern areas, is an open weave and is interwoven with the face ply in the desired pattern or design which the finished product will manifest. An intermediate ply comprises relatively bulky yarns serving as filler which will aid in supporting these same bulging pattern areas in the finished product to impart a quilted appearance and hand to the product.

After the fabric is woven, it is washed, dried and framed to a specified width.

Color is then applied to selected woven pattern areas of the face ply of the dried, framed and still-flat fabric. Preferably, an air brush technique is used to apply the color, along with suitably configured stencils having cut-outs therein which match specific portions of the pattern woven into the fabric. Using the stencils for desired pattern and color registration, the fabric is then air-brush printed. A characteristic of air-brush printing is that it imparts a water-color custom printed appearance to the selected woven pattern areas of the fabric face ply. Likewise, an advantage of stenciled coloring is the accuracy with which individual areas may be colored and clearly defined, and the precision with which a large number of similar items may be colored.

The printed fabric is then cured at elevated temperatures in order to bond the color or colorant to the fabric. Following its curing, the fabric is cut in appropriate sizes, such as for a bedspread, and overedged.

In an ensuing step, the bedspread fabric is tumble washed and dried. The nature of matelasse fabric is such that the openly-woven back ply tends to shrink a significant amount during such a treatment, while the closely woven face ply tends to shrink very little in comparison. In this regard, it will be understood that the closely woven face ply of the multi-ply fabric is not interwoven with the open woven back ply in the pattern areas, but is interwoven with the back ply along the perimeters of the pattern areas and between the pattern areas. The thus defined fabric float areas of the back ply underlying the respective pattern areas of the face ply shrink relative to the face ply pattern areas. These relative shrinkings pull or contract the face ply into a pattern of bulges predetermined by the initial weaving design of the layers. The present invention uses this shrinking and bulging characteristic in combination with air-brush printing to produce the desired product with its distinctive hand-painted custom appearance.

Specifically, because certain of the now bulged areas were previously colored, these certain areas manifest a three-dimensional custom color effect, both in the manner in which the color covers the bulge and in the shaded effect of the color achieved by the air-brush printing.

As a final step, fringe or other embellishment is added to the fabric so as to adapt it to its eventual use; for example, as a bedspread.

It will be seen as an advantage of the present invention, that because the air-brush printing step precedes the puffing or bulging step, i.e. while the fabric is flat, the application of colorant to raised three-dimensional areas of the fabric is achieved with relative ease of effort.

Similarly, the nature of the process of the invention is such that as many colors as are desired may be used.

One preferred embodiment of the product and the process of producing it will now be described with the aid of the accompanying drawings, in which.

Referring more specifically to the drawings, it will be seen that the invention presents a number of outwardly bulging fabric pattern areas colored so as to contrast with the surrounding fabric background. The nature of the invention is such that the colored areas present an ombre effect of shaded color of varying intensity. This combination of outwardly bulging or raised and colored pattern areas of varying shades gives the fabric its hand-painted custom appearance. The invention has the advantage of being adaptable to a large number of color combinations. Consequently, in various embodiments, the fabric pattern areas could be one color on a white or uncolored background fabric, one color on a dyed background fabric, two or more colors on a white or uncolored background fabric, or two or more colors on a dyed background fabric. In each case, the overall custom appearance is enhanced by the shaded ombre effect of the various colors applied to certain raised pattern areas on the fabric.

Figure 1:
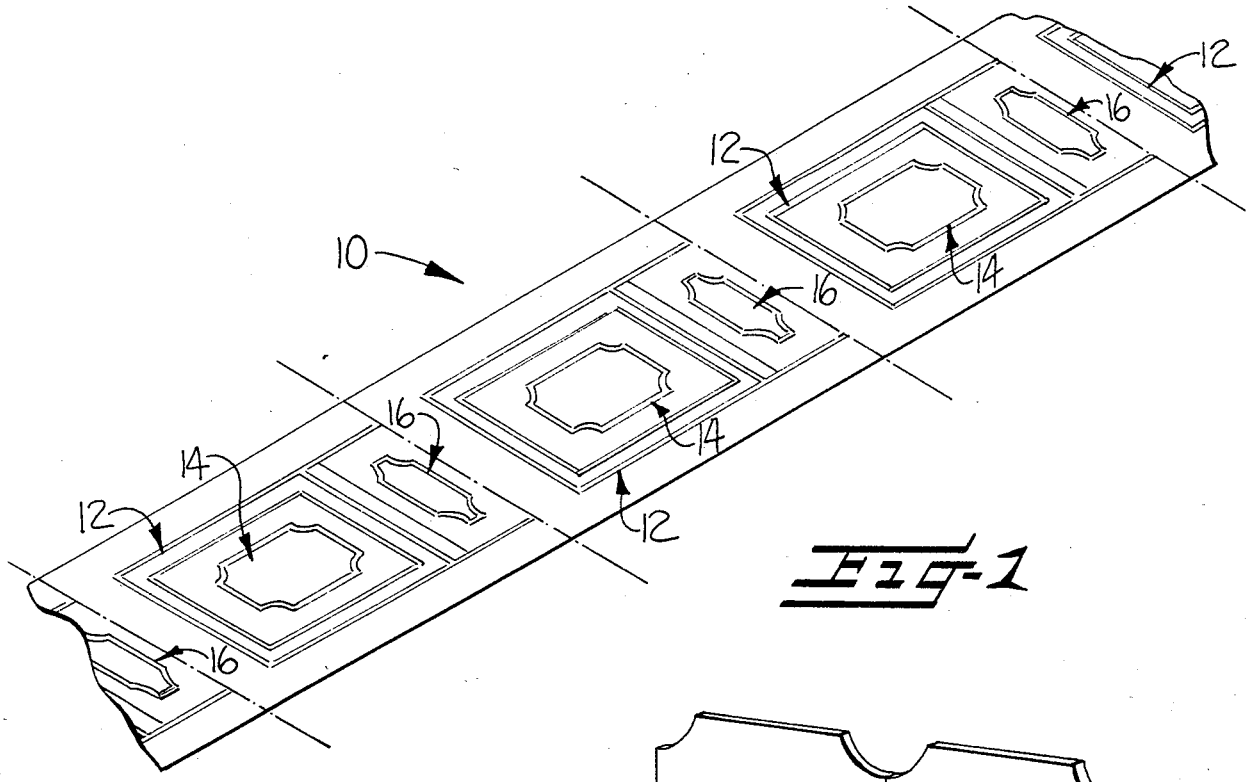
FIG. 1 is a schematic perspective view of the fabric after it has been woven and has come off the loom.
Figure 2:
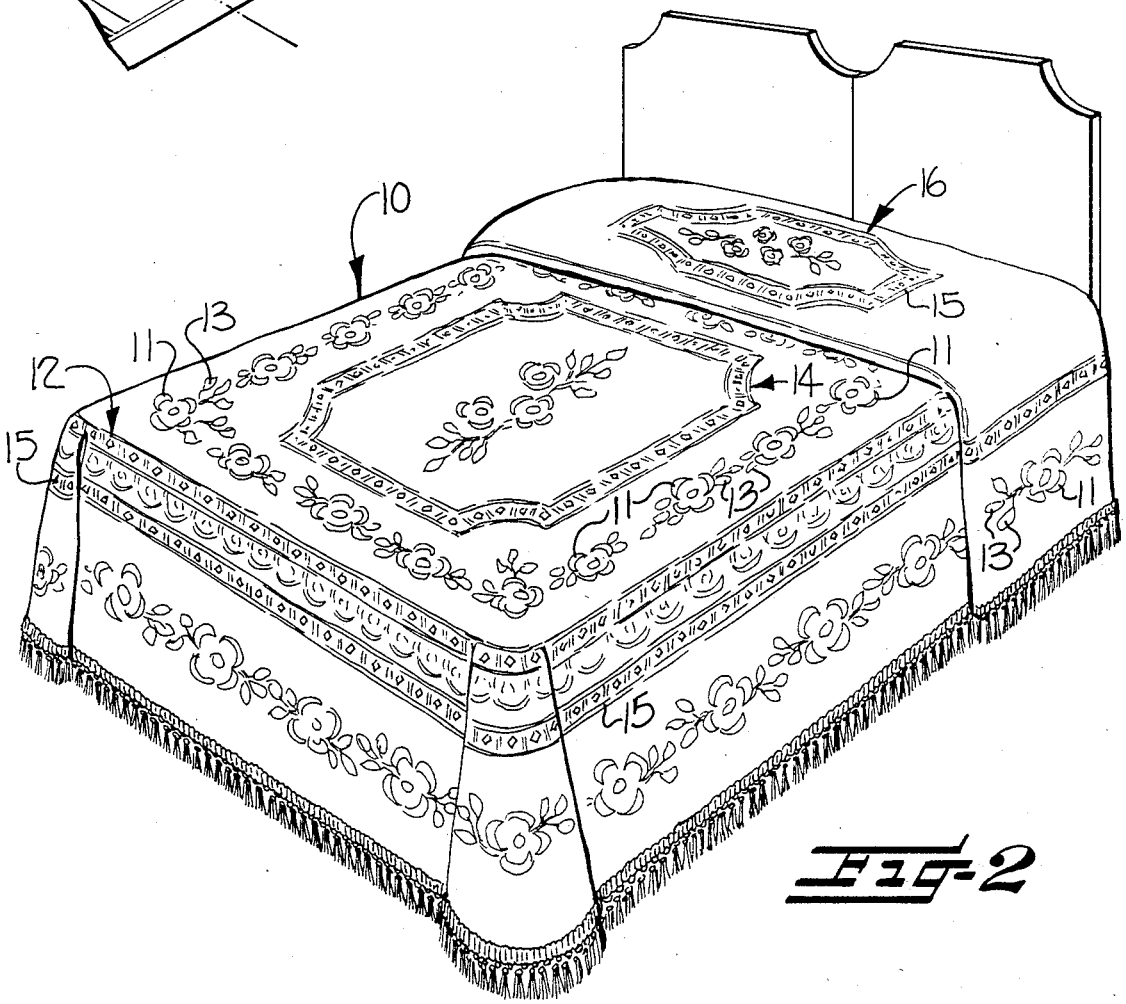
FIG. 2 is a schematic perspective view of the finished woven fabric product in use as a bedspread.

An overall view of a finished example of the product is provided in FIG. 2, which shows the woven fabric in use as a bedspread. In FIG. 2, the woven fabric is broadly designated at 10, while 12, 14 and 16 represent relatively large design areas, as illustrated by FIG. 1. Within and between the larger design areas are a number of smaller more intricate pattern areas such as are indicated at 11, 13 and 15, and which may be of various shapes and sizes.

For example, in FIG. 2, 11 represents a typical flower fabric pattern area which is outwardly bulged. Similarly, 13 represents a typical leaf fabric pattern area which is outwardly bulged. Other outwardly bulged pattern areas are likewise present. It will be understood that all of these pattern areas may or may not receive colorant depending on the desired final design appearance of the fabric. For example, in a typical commercial embodiment, the outwardly bulged flower fabric pattern area 11 may eventually receive a pink colorant while the outwardly bulged leaf fabric pattern area 13 may receive a green colorant, and yet other outwardly bulged fabric pattern areas may receive no colorant at all. The resulting embodiment has some outwardly bulged pattern areas which have a colored appearance and some which do not. It will be apparent that the pattern areas to be colored will be predetermined by the designer.

Figure 8:
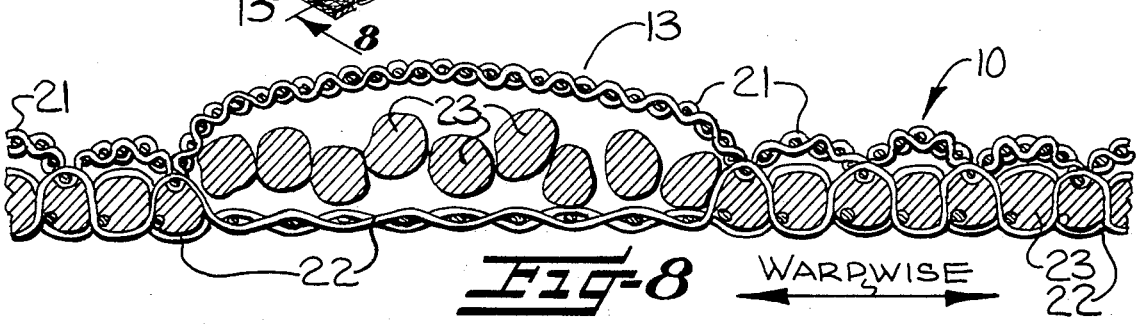
FIG. 8 is a greatly enlarged warpwise schematic sectional view taken substantially along line 8—8 of FIG. 7 showing the structure of the fabric after the bulging step has been effected.

The structure of the fabric product results in the distinctive outward bulges of the fabric pattern areas. As FIG. 8 shows in some detail, three layers or plies of fabric are interwoven to produce this effect. The three plies are: a closely woven face ply 21 with a particular pattern therein, a more open woven back ply 22, and an intermediate ply 23 formed of weft yarns floated between the face ply 21 and the back ply 22. As shown in FIG. 8, the floating intermediate ply 23 aids in maintaining the outward bulge of the fabric pattern area 13 and thereby aids in imparting a desired quilted appearance and quilted hand to the product.

As FIG. 8 further indicates, the tumble washing and drying steps of the method of the invention result in a relatively greater shrinkage of the open woven back ply 22 and a relatively lesser shrinkage of the more closely woven face ply 21. Because the plies are interwoven both with each other and with the intermediate ply 23, the greater shrinkage of the back ply 22 forces the face ply 21 to bulge outward in the desired manner, with the intermediate ply 23 helping to support the outward bulge of the pattern area 13.

As the method of the invention will more clearly show, the colors are of an ombre or shaded effect. This ombre effect, along with the registration of the color on specific outwardly bulged areas and the overall quilted appearance and quilted hand of the fabric, gives the fabric product its custom hand-painted appearance.

METHOD OF THE INVENTION

Figure 3:
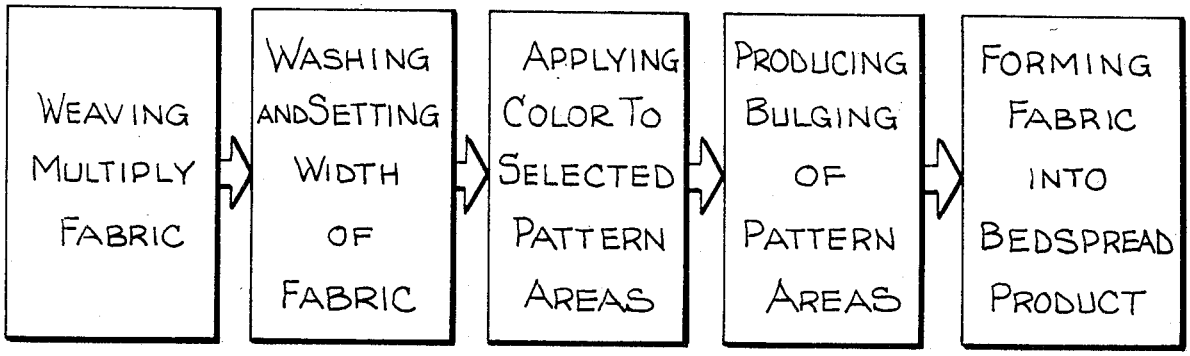
FIG. 3 is a block flow diagram illustrating a preferred series of steps in the method of the invention.

As indicated in the block diagram of FIG. 3 an initial step in the method may include weaving a multi-ply fabric having the desired pattern therein. As best illustrated in FIG. 8, the weaving step includes the weaving of a relatively closely woven face ply 21, a relatively open woven back ply 22, an intermediate ply 23 of floating warp yarns and an interweaving of the face and back plies 21, 22 at predetermined areas. This weaving forms the desired pattern in the multi-ply fabric, such as that described heretofore with respect to FIG. 2.

As a second step in the method of the invention, the fabric is washed and its width set after it has come off of the loom or weaving machine, as indicated by the second block of FIG. 3. This washing is such as to remove size and the like from the warp yarns and is not to be confused with tumble washing treatments described in a later step of the method. At this point, the fabric has substantially the appearance shown in FIG. 1 in which the larger overall fabric pattern areas 12, 14 and 16 may be visible on the fabric 10.

Figure 4:
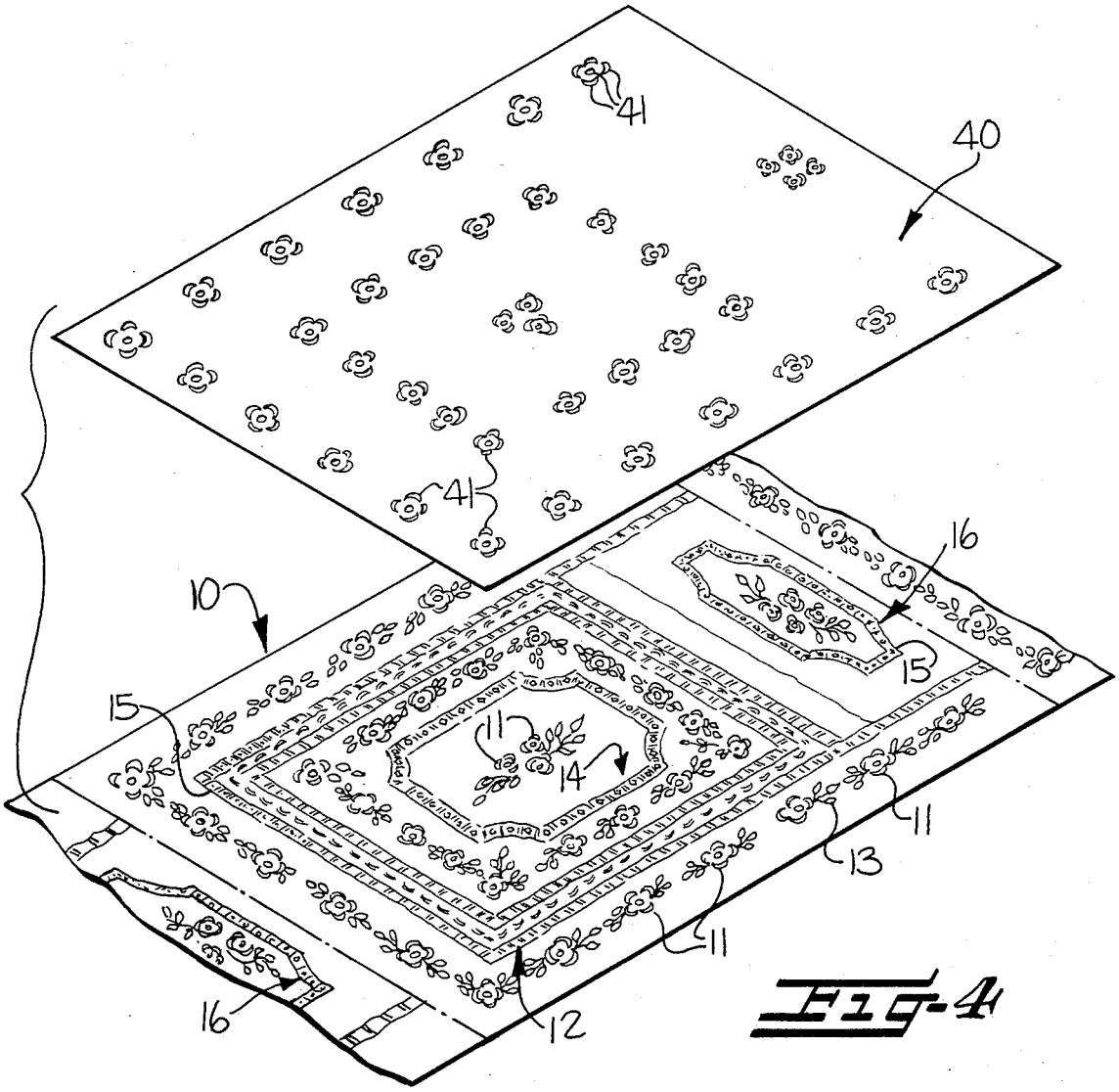
FIG. 4 is an exploded schematic perspective view showing a color stencil overlying the woven fabric as it may be employed in the color-application step of the method.
Figure 5:
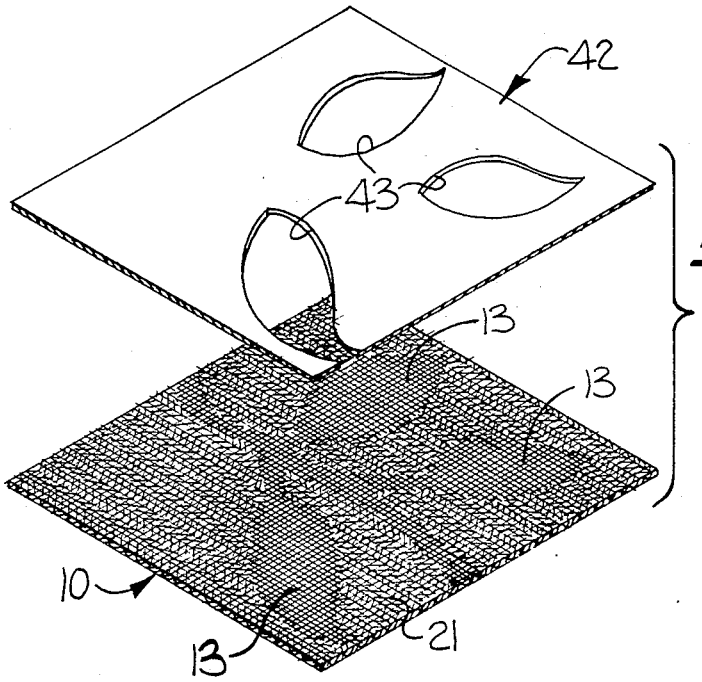
FIG. 5 is a fragmentary, partially exploded schematic perspective view of a small portion of a stencil overlying a portion of the woven fabric.
Figure 6:
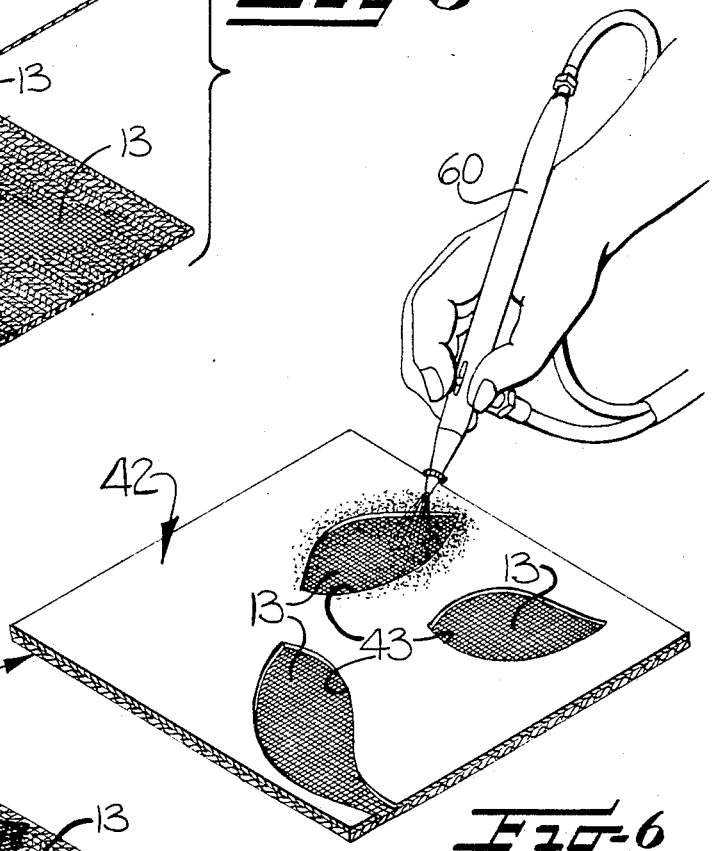
FIG. 6 is a schematic view of a small portion of the stencil overlying a small portion of the woven fabric and showing how color may be applied to the fabric face ply through the use of an air brush.

In the third and highly significant step of the method, colorant is applied to certain of the fabric pattern areas. FIGS. 4, 5 and 6 best illustrate the coloring step of the method.

FIGS. 4 and 5 particularly illustrate the preparation part of the coloring step. Initially, a stencil 40 (FIG. 4), with a predetermined pattern of cutouts 41 therein, is positioned to overlie the woven fabric 10. As shown in FIG. 4, the stencil 40 may be provided with cutouts 41 of any desired size and shape arranged so as to be in substantial registration with predetermined portions of the woven pattern areas of the face ply 21 of the fabric 10 when the stencil 40 is properly positioned on the face of the fabric 10. It may be desirable to provide some pattern areas or portions thereof of a different color or colors than other of the pattern areas or other portions of certain pattern areas. Thus, it will be noted that the particular stencil shown in FIG. 4, is provided with cutouts 41 arranged to register with only certain of the pattern areas of the face ply 21 of the fabric 10. Meanwhile the stencil 40 is shielding other pattern areas as well as the remainder of at least the major portion of the face ply of the fabric 10. For example, the cutouts 41 in the stencil shown in FIG. 4 are of flower petal shape and arranged to be positioned substantially in registration with the petal shaped portions of the flower fabric pattern area 11, which may be colored pink through the use of an air brush with this particular stencil. It is apparent that many of the different fabric pattern areas, such as 11 and 13, may be colored differently by air brush simply by using different cutout stencils and applying different colors to these different fabric pattern areas.

FIGS. 5 and 6 illustrate in detail the use of a stencil 42 having differently configured cutouts than stencil 40 and an air brush 60 to produce color on the woven fabric 10. As shown in FIG. 5, the stencil 42 is cut so that, when the stencil is positioned properly over the fabric, the cutouts 43 are in registration with certain fabric pattern areas 13. In FIG. 5, the illustrated stencil 42 has its cutouts 43 configured in a leaf pattern in contrast to stencil 40 of FIG. 4 whose cutouts are arranged in a set of petal patterns. When the use of the two stencils is viewed in sequence, the method shows a simple way to place several colors in close proximity to one another so as to produce the likeness of a particular object (e.g. a pink flower with green leaves) upon the fabric product. The invention has the advantage of providing for the application of any number of different colors to any number of different fabric areas by use of different colors and stencils.

As indicated earlier, the color itself is applied by the use of an air brush such as that indicated by numeral 60 in FIG. 6. FIG. 6 shows the stencil 42 overlying the woven fabric 10 as the air brush 60 is employed for applying color to the fabric via the cutouts in the stencil. As illustrated, the stencil cutouts 43 are in registration with specific fabric pattern areas 13. The air brush 60 allows an easy application of color, to permit one to readily obtain the ombre or shaded color effects which give the finished product its custom hand-painted appearance.

In order to bond the colorant to the fabric prior to the tumbling wash treatments to be discussed below, the fabric is next passed through a heated chamber and cured at a suitable temperature correlated to the type of colorant applied.

In preparation for the tumbling wash and dry treatments in the course of producing the bulge of the pattern areas, the woven fabric is cut into appropriate griege sizes. Once cut, the woven fabric product is subjected to an aqueous tumbling wash treatment followed by a tumble drying treatment. The effect of these treatments on the structure of the woven fabric product is such that, as illustrated in FIG. 8, the relatively open woven (low number of warp and weft yarns per square inch) back ply 22 shrinks a relatively large amount while the relatively closely woven (greater number of warp and/or weft yarns per square inch) face ply 21 shrinks a relatively lesser amount. Consequently, the tumbling treatments gather the fabric into outwardly bulging areas whose size, shape and location were predetermined by the originally woven pattern. As further illustrated in FIG. 8, the intermediate ply of relatively large warp yarns 23, which is floated in the pattern areas, helps support the fabric bulges and gives a quilted appearance and quilted hand to the final product.

Figure 7:
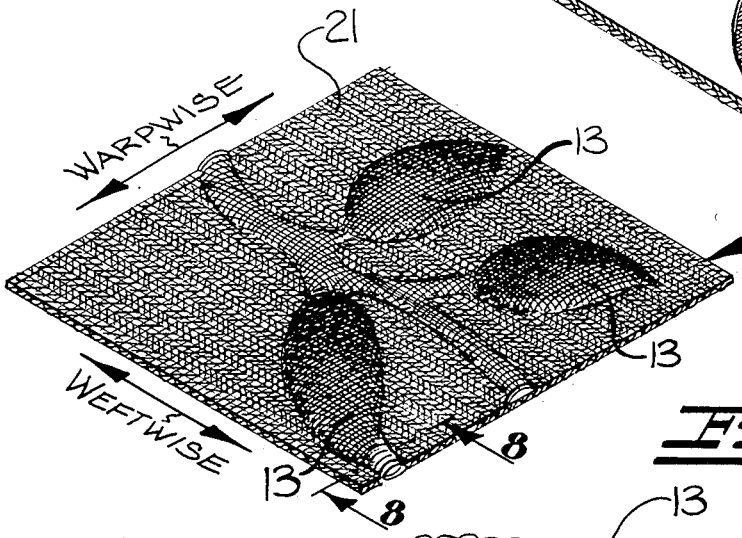
FIG. 7 is a schematic view of a small portion of the woven fabric after it has been tumble washed and dried to produce the desired bulges in pattern areas following the application of color thereto.

As shown in FIG. 7, the tumbling treatments to which the fabric is subjected result in the formation of outwardly bulging pattern areas throughout the fabric as predetermined by the weave design. In FIG. 7 the bulged area 13 is shown as a leaf and stem pattern. As noted earlier, the bulged leaf pattern areas 13 and petal areas 11 were previously air-brush printed while the entire fabric was flat. Consequently, after the tumble treatment, the pink and green colors are now in registration with the predetermined bulged woven fabric pattern areas.

The final resulting several colors of ombre or shaded characteristic, the registration of the colors to particular bulged pattern areas and the quilted appearance and quilted hand of the fabric, all combine to give the final woven fabric its particularly unique hand-painted custom appearance.

In the drawings and specification, there has been set forth a preferred embodiment of the invention, and although specific terms are employed, they are used in a generic and descriptive sense only and not for purposes of limitation.

That which is claimed is:

1. A decorative matelasse fabric of woven multi-ply construction including a closely woven face ply interwoven with an open woven back ply, said face ply having predetermined outwardly bulging fabric pattern areas thereon, said back ply having shrunken fabric float areas underlying said outwardly bulging fabric pattern areas in the face ply, said shrunken fabric float areas serving to maintain the outward bulge of the fabric pattern areas, at least some of said outwardly bulging fabric pattern areas being colored so as to contrast with the surrounding fabric background, and said colored areas presenting an ombre effect of shaded color areas of varying intensity of color so as to present a custom hand-painted appearance.

2. A fabric according to claim 1 wherein some of said outwardly bulging colored pattern areas are of a different color than other colored pattern areas and wherein the fabric background surrounding the pattern areas is uncolored for highlighting the colored pattern areas of the fabric.

3. A fabric according to claim 1 including an intermediate ply formed of weft yarns floated between said face ply and said back ply in said pattern areas and being interwoven with said back and face plies in the surrounding fabric background.

4. A decorative matelasse bedspread having a rectangular body of woven multi-ply fabric construction including a closely woven face ply interwoven with an open woven back ply, said face ply having predetermined outwardly bulging fabric pattern areas thereon, said back ply having shrunken fabric float areas underlying said outwardly bulging fabric pattern areas in the face ply, said shrunken fabric float areas serving to maintain the outward bulge of the fabric pattern areas, at least some of said outwardly bulging fabric pattern areas being colored so as to contrast with the surrounding fabric background, said colored areas being shaded color areas of varying intensity of color so as to present a custom hand-painted appearance, and a decorative fringe secured to said woven body and extending along opposing sides and an end thereof for enhancing the aesthetic appeal of the bedspread.

5. A bedspread according to claim 4 wherein said rectangular body includes an intermediate ply formed of weft yarns floated between said face ply and said back ply in said pattern areas and being interwoven with said back and face plies in the surrounding fabric background.

6. A bedspread according to claim 4 wherein some of said outwardly bulging colored pattern areas are of a different color than other colored pattern areas and wherein the fabric background surrounding the pattern areas is uncolored for highlighting the colored pattern areas of the bedspread.

7. A method of forming a decorative matelasse fabric which comprises weaving a multi-ply fabric of interwoven plies so as to form a relatively closely woven face ply and a relatively open woven back ply, while weaving said face ply to have predetermined pattern areas woven therein, and while interweaving said back ply with the face ply to provide back ply fabric portions floated behind the woven pattern areas of the face ply, applying a colorant to and substantially in registration with at least some of said woven pattern areas on the face ply so as to obtain an ombre effect of shaded color areas of varying intensity of color on the woven pattern areas, subjecting the thus colored fabric to an aqueous treatment while tumbling the fabric to effect shrinkage of the fabric and to cause the floated fabric portions of the open woven back ply to shrink to such an extent as to cause the face ply in the pattern areas to bulge outwardly to thereby present a three dimensionsal effect to the colored pattern areas and thus creating a custom hand painted appearance.

8. A method according to claim 7 wherein the step of applying a colorant to the pattern areas of the fabric to obtain shaded areas of varying intensity of color comprises applying colorant by air brushing colorant onto the fabric through cutouts of a stencil overlying and positioned substantially in registration with the pattern areas of the fabric which are to be colored.

9. A method according to claim 7 including curing the colorant applied to the fabric by passing the fabric with the colorant thereon through a heated chamber prior to effecting shrinkage of the fabric.

10. A method according to claim 7 including washing the woven fabric to remove sizing from the yarns thereof in preparation for applying the colorant to the fabric, and setting the width of the washed fabric prior to applying the colorant to woven pattern areas of the fabric.

* * * * *